United States Patent [19]

Austin

[11] 4,205,458

[45] Jun. 3, 1980

[54] METHOD AND APPARATUS FOR DRYING PARTICULATE MATERIAL

[75] Inventor: Oliver K. Austin, Bartlesville, Okla.

[73] Assignee: Phillips Petroleum Company, Bartlesville, Okla.

[21] Appl. No.: 866,134

[22] Filed: Dec. 30, 1977

[51] Int. Cl.[2] ..... F26B 21/04

[52] U.S. Cl. ..... 34/134; 34/135; 34/137; 165/90

[58] Field of Search ..... 34/128, 130, 131, 133, 34/139, 138, 134, 2, 137, 135; 165/89, 90

[56] References Cited

U.S. PATENT DOCUMENTS

| | | | |
|---|---|---|---|
| 1,332,137 | 2/1920 | Newhouse | 34/137 X |
| 1,431,037 | 10/1922 | Prindle | 34/6 |
| 1,959,061 | 5/1934 | Perkins | 34/6 |
| 2,082,682 | 6/1937 | Cardenas | 165/90 X |
| 2,213,667 | 9/1940 | Dundas et al. | 34/134 X |
| 3,168,383 | 2/1965 | Loewen | 34/137 |

FOREIGN PATENT DOCUMENTS

| | | | |
|---|---|---|---|
| 528233 | 7/1931 | Fed. Rep. of Germany | 34/137 |
| 16294 | of 1905 | United Kingdom | 34/137 |

*Primary Examiner*—William F. O'Dea

*Assistant Examiner*—Harold Joyce

[57] ABSTRACT

An apparatus for drying particulate material includes an elongate housing having a chamber therein. A drum is positioned in the housing and has opposite ends thereof extending through open ends of the housing. The drum is mounted for rotation about its longitudinal axis. The exterior surface of the drum and the interior surface of the housing are spaced apart and form an annular space adapted for flow of heating medium therealong. An inlet opens into the annular space and is directed for introducing heating medium in a generally tangential direction relative to the annular space such that the heating medium flows in a generally vortex manner along the length of the annular space to the outlet. A tube is positioned in the drum and extends along a major portion of the length of the drum. The tube is in flow communication with the annular space for receiving heating medium therefrom. The heating medium flows along the tube for heating the particulate material in the drum and the heating medium in the tube is discharged into the interior of the drum for direct contact with the particulate material and further heating thereof. The material to be dried is introduced into one end of the drum and discharged from the other end of the drum after drying.

4 Claims, 3 Drawing Figures

METHOD AND APPARATUS FOR DRYING PARTICULATE MATERIAL

The present invention relates to an apparatus and method for drying particulate material. In one aspect, the present invention relates to an improved process and apparatus for drying wet carbon black pellets.

In the wet pelleting of loose or flocculent carbon black, as practiced commercially, the wet pellets emerge from the pelleting step containing a substantial amount of water, for example about 50 percent by weight. It is therefore necessary to dry the pellets before storage or shipment. In order to accomplish this, the pellets from the pelleting mills are passed through a dryer where they are heated, for example, by contact with a purge gas. The purge gas can be comprised of gaseous products of combustion resulting from burning fuel to supply heat to the dryer.

One particularly useful type of dryer is a rotary dryer as is known in the art. For example, the dryer disclosed in U.S. Pat. No. 3,168,383, issued Feb. 2, 1965. In such dryers particulate material, such as carbon black pellets, is introduced into a drum which rotates about its longitudinal axis within a furnace. The drum can be tilted from the horizontal to assist the granular material to traverse the longitudinal length of the drum as it is tumbled or agitated by the rotary action of the drum. One or more burners can be located in the furnace preferably beneath the rotating drum, to provide heat from burning combustion gases for drying the particulate material. Usually a portion of the combustion gases from the furnace is passed through the rotating drum as purge gas to carry out the released moisture. The purge gases can be introduced in one of several ways. One way is disclosed in the U.S. Pat. No. 3,168,383 wherein the purge gas is introduced adjacent the discharge end of the drum through a manifold arrangement. The purge gas can also be introduced into the hood through which the dried particulate material is discharged. The purge gas flows through the rotating drum in countercurrent flow relationship to movement of the particulate material moving along the length of the drum.

Apparatuses such as that described above are effective in operation. However, the present invention improves the heat transfer relationship between the heating medium or hot combustion gases and the particulate material within the drum. An improvement in the heat transfer relationship consequently improves the operating efficiency of such dryers. Such an improvement provided by the present invention over the dryers known in the art will become more apparent from the following disclosure.

It is an object of the present invention to provide a particulate material drying apparatus and method which provides improved operating efficiency. It is an object of the present invention to provide a drying apparatus which is simple in construction and simple in operation. It is a further object of the present invention to provide an apparatus and method for drying particulate material which are well adapted for their intended use.

Other objects and advantages of the present invention will become apparent from the following detailed description taken in connection with the accompanying drawings wherein are set forth by way of illustration and example certain embodiments of this invention.

Figure 1:
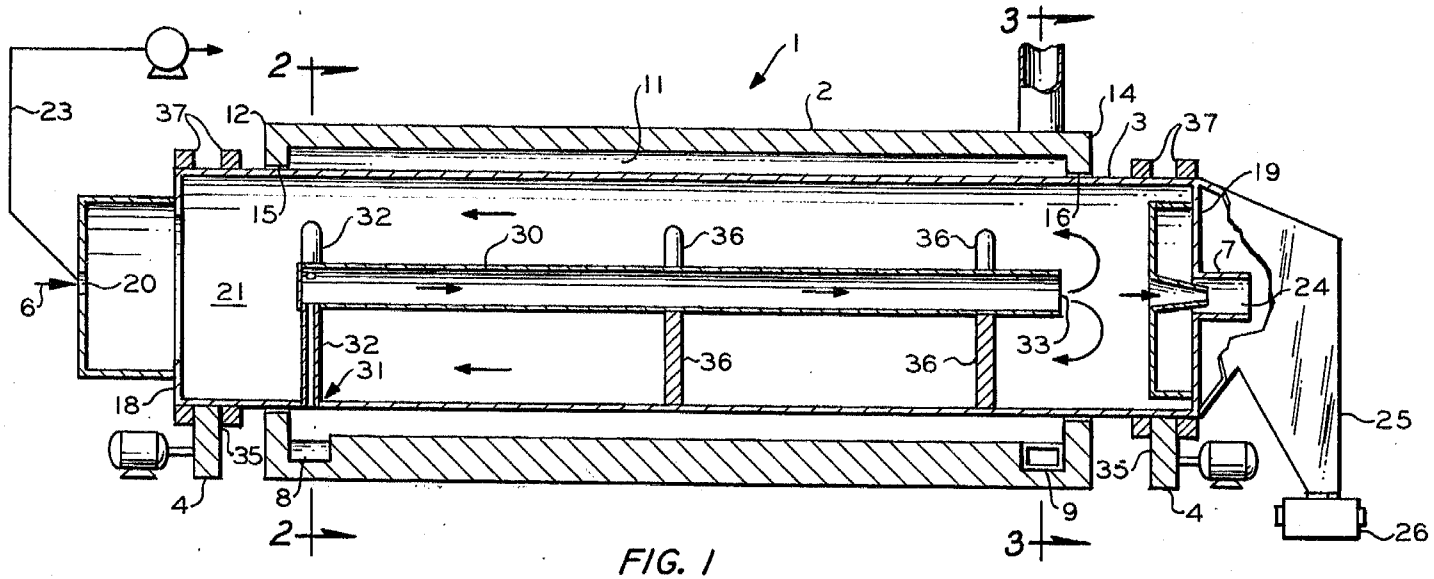
FIG. 1 is a cross-sectional view of an apparatus for drying particulate material.
Figure 3:
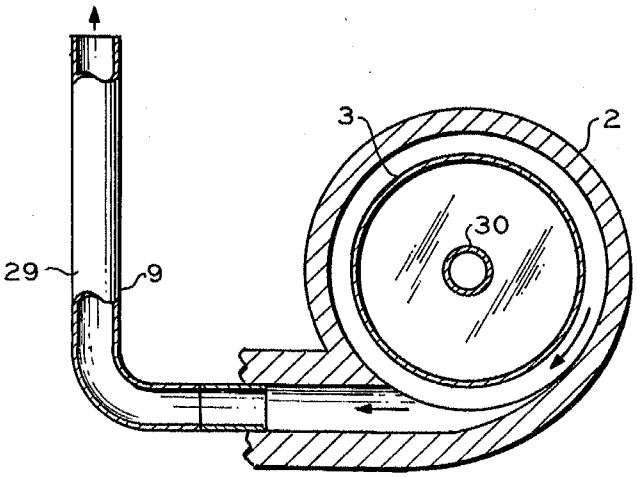
FIG. 3 is a sectional view of the apparatus taken along the line 3—3, FIG. 1.
Figure 2:
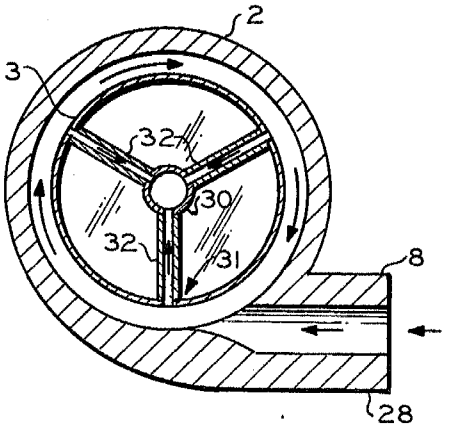
FIG. 2 is a sectional view taken along the line 2—2, FIG. 1.

The reference numeral 1 designates generally an apparatus for drying particulate material. The apparatus 1 includes an elongate housing 2 which defines an interior chamber 11 and which has mounted therein a drum 3. Preferably the drum 3 is mounted for rotation about its longitudinal axis and is driven for rotation by drive means 4. Particulate material inlet means 6 is at one end of the drum 3 while at the other end of the drum 3 there is provided outlet or discharge means 7. Heating medium is supplied to the housing 2 for heating particulate material contained within the drum 3. The heating medium is introduced into the housing 2 via inlet means 8 which is positioned and directed to inject the heating medium in a generally tangential direction relative to the chamber 11 to effect vortex flow of the heating medium along the length of the drum 3. The heating medium after flow along the exterior of the drum 3 is discharged via outlet means 9.

In the illustrated structure the housing 2 can have any desirable exterior shape and has an interior surface which preferably is generally cylindrical and defines an interior chamber or zone 11 which preferably is generally cylindrically shaped. At opposite ends 12 and 14 of the housing 2 there are provided openings 15 and 16, respectively, through which the drum 3 extends. The space between the surfaces defined in the openings 15 and 16 and the exterior of the drum 3 is sealed or otherwise kept at a minimum to prevent the loss of heating medium or prevent the unintentional introduction of air into the chamber 11. The housing 2 can be of any suitable material such as a refractory or metal and preferably is insulated to reduce the exterior temperature thereof and reduce heat loss therefrom. Also, the refractory will become heated and provide radiant heat transfer to the drum 3 particularly in the proximity of the end 12.

The drum 3 preferably is generally cylindrically shaped and is elongate having opposite ends 18 and 19 extending through the openings 15 and 16, respectively. The exterior of the drum 3 is spaced from the interior surface of the housing 2 and the interior surface of the housing 3 is shaped such that the chamber 11 is an annular space which preferably is generally cylinidrical for flow of heating medium along a major portion of the length of the exterior of the drum 3. The annular spacing between drum 3 and housing 2 is usually about 6 to about 8 inches. The end 18 is an inlet end while the end 19 is an outlet or discharge end for the particulate material. The inlet means 6 cooperates with the end 18 in a suitable manner such that during rotation of the drum 3 particulate material such as wet loose carbon black or wet pelleted carbon black is introduced through an opening 20 into a drying chamber or zone 21 of the drum 3. The opening 20 also functions as an outlet for wet purge gas which is discharged via a discharge line 23 during rotation of the drum. The end 19 has a discharge opening 24 through which dried particulate material is discharged from the drying chamber 21. The discharge opening 24 preferably opens into a stationary hood 25, or the like and through a suitable valve means 26 such as a star valve which is effective for preventing the loss of purge gas through the opening 24 or the entry of air or the like, depending on the operating pressure of apparatus 1.

The inlet means 8 includes a conduit means 28 which extends through the wall of the housing 2 and opens into the annular space 11 immediately adjacent to or at the end 18. The conduit means 28 is directed in a generally tangential direction, relative to the annular space 11, into the annular space 11 such that heating medium injected into the annular space via the conduit 28 will flow in a generally vortex manner in the annular space along the exposed length of the drum 3 in the chamber 11. The annular space 11 functions as a heating chamber or zone for heating drum 3 so that the particulate material contained within the drum 3 is heated by indirect heat exchange with the heating medium. After the heating medium has flowed in annular space 11 along the length of the drum 3 within the housing 2, the heating medium is discharged via the outlet means 9. The outlet means 9 can assume any suitable shape or configuration and as shown the outlet means 9 includes a conduit means 29 which opens into the annular space 11 and is generally tangentially directed relative to the annular space 11, preferably for corotational discharge of heating medium. Corotational discharge from the annular space 11 will result in the discharged heating medium being subjected to less pressure drop during discharge. The conduit means 29 opens into the annular space 11 immediately adjacent to or at the end 19. The inlet conduit 28 can be decreased in cross-sectional area at the outlet end to increase the velocity of the heating medium in order to improve heat transfer. The conduit 29 can form a stack to create a vacuum which helps exhaust the heating medium.

To enhance the efficiency of the drying of the particulate material, an elongate tubular member 30 is mounted as with braces 36 within the drying chamber 21 and is generally coaxial with the drum 3. The tubular member 30 extends along a major portion of the length of the drying chamber 21 (e.g. 60% or more). Inlet means 31 connects in flow communication the annular space 11 and the tubular member 30. The inlet means 31 as shown includes a plurality of generally radially extending, with respect to the tubular member 30, conduits 32. Each conduit 32 has one end opening into the annular space 11 and the other end opening into the tubular member 30 preferably immediately adjacent the end of the tubular member 30 most adjacent the inlet end 18. By having the conduits 32 open into the annular space 11 at the locus of the inlet end 18, the heating medium flowing thereinto will be at a higher pressure than it would if the heating medium were taken at a position closer to the end 19. The higher pressure, which preferably is above atmospheric, prevents leakage of air into the drum 3. This reduces fire hazards and corrosion in the discharge 23 and downstream equipment such as purge gas filter (not shown) by reducing or eliminating oxygen leakage. Leakage of air into the drum 3 can also reduce the temperature of the gases in the drum 3 and oxidize the product, both of which are detrimental. A portion of the heating medium flows from the annular space 11 through the conduits 32 and then along the length of the tubular member 30 in a direction generally cocurrent with the direction of movement of particulate material from the end 18 to end 19 along the drying chamber 21. This portion of the heating medium is discharged from the tubular member 30 via a discharge opening 33. Preferably, the opening 33 is at or immediately adjacent the end of the tubular member opposite the end into which the conduits 32 open. The opening 33 preferably is positioned immediately adjacent or at the discharge end 19 of the drum 3. Thus, the heating medium discharged via the opening 33 flows through the drying chamber in a direction generally countercurrent to the flow of particulate material from the end 18 to end 19 along the length of the drying chamber 21 for discharge via line 23. The portion of the heating medium injected into the drying chamber 21 via the opening 33 is in direct heat exchange relationship with the particulate material while the portion of the heating medium flowing within the tubular member 30 is in indirect heat exchange relationship with the particulate material in the drying chamber 21.

The particulate material during drying is preferably agitated, which is advantageously accomplished by rotating the drum 3 via the drive means 4. The drive means 4 can be of any suitable type such as power driven wheels 35 which preferably drive the drum via frictional contact between the drum and the wheels 35. As is known in the art, a track 37 can be provided on the exterior of the drum 3 to maintain the drum 3 in proper alignment during operation.

In order to illustrate operation of the present invention the following data is provided to show the improved operation of a dryer as disclosed above compared to a dryer substantially like that disclosed in U.S. Pat. No. 3,168,383.

| Wet Carbon Black Pellets to Dryer: | Prior | Invention |
|---|---|---|
| N330 Carbon Black, Wt. %, | 50 | 50 |
| Water, Wt. %, | 50 | 50 |
| Wet Pellets to Dryer, Lbs/Hr., | 12,575 | 12,815 |
| Dried Pellets From Dryer: | | |
| N330 Carbon Black, Wt. %, | 99.8 | 99.8 |
| Water, Wt. %, | 0.2 | 0.2 |
| Pounds/Hr. Dried Pellets, | 6,300 | 6,420 |
| Dryer Temperature, °F., | 500 | 500 |

Based on the above data and the operating conditions of both types of dryers and accounting for differences in operation, it is believed that the dryer which is the subject of this invention provided a 2 percent greater output capacity and used an estimated 15% less input of heat to the apparatus 1 to produce substantially the same dryness in the dried pellets.

It is to be understood that while there has been illustrated and described certain forms of this invention, it is not to be limited to the specific form or arrangement of parts herein described and shown except to the extent that such limitations are found in the claims.

What is claimed and desired to be secured by Letters Patent is:

1. An apparatus for drying particulate material, said apparatus including:

a housing having a generally cylindrical interior surface defining an elongate first chamber therein and having first and second ends;

a drum having a portion thereof positioned in said first chamber and having first and second ends, said drum having an exterior surface spaced from the interior surface of said housing thereby forming a generally annular space therebetween for the flow of heating medium along a major portion of the exterior surface of the drum, said drum having a second chamber therein;

a tubular member having a first end and a second end positioned in said second chamber with said tubular member first being more adjacent said drum first end than said drum second end and said tubular member second end being more adjacent said drum second end than said drum first end, said tubular member extending along at least a major portion of the length of said second chamber, and the second end of said tubular member being a discharge opening into said second chamber adjacent the second end of the drum for flow of heating medium along the length of the second chamber;

conduit means connecting said tubular member in flow communication with said annular space, said conduit means opening into said tubular member immediately adjacent said tubular member first end for flow of heating medium from said annular space to said tubular member for flow through said tubular member and discharge through said discharge opening into said second chamber;

a first inlet means opening into said annular space in a generally tangential direction relative to said first chamber interior surface immediately adjacent said housing first end and being operable for introducing a heating medium into said first chamber for vortex flow in said annular space;

a first outlet means opening into said first chamber immediately adjacent said housing second end and being operable for discharge of said heating medium;

drive means cooperating with said drum for rotating said drum generally about its longitudinal axis;

a second inlet means communicating with said second chamber at said drum first end and operable for introducing particulate material to be dried into said second chamber; and a second outlet means communicating with said second chamber at said drum second end and operable for discharge of particulate material from said second chamber.

2. An apparatus as set forth in claim 1 wherein said conduit means includes a plurality of conduits extending generally outwardly from said tubular member to said drum, each said conduit having one end opening into said annular space and each said conduit having another end opening into the interior of said tubular member.

3. An apparatus as set forth in claim 1 wherein said housing first and second ends are open ends and a portion of said drum adjacent said drum first end extends through said housing first open end and a portion of said drum adjacent said drum second end extend through said housing second open end.

4. An apparatus as in claim 1 wherein said first outlet means opens into said first chamber in a generally tangential direction relative to said first chamber interior surface.

* * * * *

UNITED STATES PATENT AND TRADEMARK OFFICE

CERTIFICATE OF CORRECTION

PATENT NO. :4,205,458

DATED :Jun. 3, 1980

INVENTOR(S) : Oliver K. Austin

It is certified that error appears in the above-identified patent and that said Letters Patent are hereby corrected as shown below:

Column 4, line 64, claim 1, line 11, after "of" and before "heating" should be --- a ---.

Column 5, line 1, claim 1, line 16, after "first" should be --- end ---.

Column 6, line 22, Claim 3, line 5, "extend" should be --- extends ---.

Signed and Sealed this

*Twenty-eighth* Day of *October 1980*

[SEAL]

*Attest:*

SIDNEY A. DIAMOND

*Attesting Officer*

*Commissioner of Patents and Trademarks*